US009718272B2

(12) United States Patent
Shimazoe

(10) Patent No.: US 9,718,272 B2
(45) Date of Patent: Aug. 1, 2017

(54) INKJET RECORDING DEVICE

(71) Applicant: Konica Minolta, Inc., Chiyoda-ku, Tokyo (JP)

(72) Inventor: Masanori Shimazoe, Hino (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/121,510

(22) PCT Filed: Feb. 19, 2015

(86) PCT No.: PCT/JP2015/054605
§ 371 (c)(1),
(2) Date: Aug. 25, 2016

(87) PCT Pub. No.: WO2015/129544
PCT Pub. Date: Sep. 3, 2015

(65) Prior Publication Data

US 2016/0361923 A1 Dec. 15, 2016

(30) Foreign Application Priority Data

Feb. 28, 2014 (JP) ..... 2014-038127

(51) Int. Cl.
*B41J 2/145* (2006.01)
*B41J 2/155* (2006.01)
*B41J 25/00* (2006.01)

(52) U.S. Cl.
CPC ..... *B41J 2/155* (2013.01); *B41J 2/145* (2013.01); *B41J 25/001* (2013.01); *B41J 25/003* (2013.01); *B41J 2202/20* (2013.01)

(58) Field of Classification Search
CPC ..... B41J 2/155; B41J 2/145; B41J 2202/20; B41J 25/001; B41J 25/003
See application file for complete search history.

(56) References Cited

U.S. PATENT DOCUMENTS

2011/0128323 A1* 6/2011 Saito ..... B41J 2/155 347/40
2011/0187795 A1* 8/2011 Ishii ..... B41J 2/14 347/49

FOREIGN PATENT DOCUMENTS

| | | | |
|---|---|---|---|
| JP | 05138885 | A | 6/1993 |
| JP | 2003080740 | A | 3/2003 |
| JP | 2003226005 | A | 8/2003 |
| JP | 2006088568 | A | 4/2006 |
| JP | 2006137178 | A | 6/2006 |
| JP | 2006264188 | A | 10/2006 |
| JP | 2006327108 | A | 12/2006 |

(Continued)

OTHER PUBLICATIONS

International Preliminary Report on Patentability and Written Opinion of the International Searching Authority corresponding to Application No. PCT/JP2015/054605; Date of Mailing: Sep. 6, 2016, with English Translation.

(Continued)

*Primary Examiner* — Manish S Shah
*Assistant Examiner* — Yaovi M Ameh
(74) *Attorney, Agent, or Firm* — Cantor Colburn LLP

(57) ABSTRACT

Provided is an attachment member that prevents the misalignment of a plurality of recording heads caused by rotation in attaching the recording heads to a head module which constitutes a head unit of an inkjet recording device.

12 Claims, 8 Drawing Sheets

(56) References Cited

FOREIGN PATENT DOCUMENTS

| | | | |
|---|---|---|---|
| JP | 2009208443 | A | 9/2009 |
| WO | 2012086520 | A1 | 6/2012 |

OTHER PUBLICATIONS

International Search Report corresponding to Application No. PCT/JP2015/054605; Date of Mailing: Apr. 21, 2015, with English translation.

* cited by examiner

INKJET RECORDING DEVICE

This is the U.S. national stage of application No. PCT/JP2015/054605, filed on Feb. 19, 2015. Priority under 35 U.S.C. §119(a) and 35 U.S.C. §365(b) is claimed from Japanese Application No. 2014-038127, filed Feb. 28, 2014, the disclosure of which is also incorporated herein by reference.

TECHNICAL FIELD

The present invention relates to an inkjet recording device.

BACKGROUND ART

There have been conventionally inkjet recording devices which form images on recording media by ejecting ink from a plurality of nozzle openings. In the inkjet recording devices, an increasing number of nozzle openings have been arranged in high density in accordance with improvement of accuracy of the formed images.

In order to achieve faster image formation, the inkjet recording devices are provided with a plurality of inkjet heads (nozzle units) arranged in parallel to form a wide range of images at once. When the interval of nozzle openings in a width direction is narrowed in accordance with the improvement of accuracy, it is difficult to arrange the nozzle openings in a single row. Thus, there has been used a technique of providing the nozzle openings in high density in the width direction as a whole by arranging the nozzle openings so as to be dispersed in a plurality of rows in the conveyance direction. In order to prevent the plurality of inkjet heads from occupying large space, Patent document 1 discloses a technique in which a plurality of print head subunits (head chips, recording heads) is attached to a structure rod material in a staggered manner. The Patent documents 2 and 3 disclose techniques which shorten the width in the conveyance direction of a recording medium by forming head units arranged in such staggered manner in a nearly trapezoidal shape and alternately arranging the head units.

The position accuracy in attaching the inkjet heads has been important for image accuracy in accordance with the increase in density of nozzle openings arrangement. The position accuracy includes relative position accuracy between a plurality of inkjet heads. Thus, there has been recently a technique of accurately attaching head chips of inkjet heads to head modules by using an optical measuring scope or such like.

PRIOR ART DOCUMENTS

Patent Documents

Patent Document 1: Japanese Patent Application Laid Open Publication No. H5-138885

Patent Document 2: Japanese Patent Application Laid Open Publication No. 2006-88568

Patent Document 3: Japanese Patent Application Laid Open Publication No. 2003-226005

DISCLOSURE OF THE INVENTION

Problems to be Solved by the Invention

However, when recording heads and a head module including a plurality of recording heads are fixed to an attachment member of the inkjet recording device, the accurate fixation using the above-mentioned optical measuring scope is difficult, and the fixation needs to be performed mechanically by using screws, springs and such like. Thus, there is a problem that large misalignment easily occurs compared to a case of fixing recording heads to a head module and a case of integrally forming a plurality of recording heads.

The misalignment includes not only misalignment in a parallel direction but also misalignment in a rotational direction. In the misalignment in a rotational direction, the degree and direction of misalignment vary depending on relative positions from a rotation axis of respective nozzle openings, and thus, the width between adjacent nozzle openings is narrowed (overlapped) or broadened according to the position in the recording head. Especially, in a case where the recording heads are attached to the attachment member individually, and in a case where nozzles are arranged in a plurality of rows in the conveyance direction according to conventional staggered arrangement and such like of recording head and the nozzles are attached to the attachment member together, there is a problem that a relatively large misalignment occurs in the width direction with respect to the rotation angle of rotational misalignment and the image quality is deteriorated.

An object of the present invention is to provide an inkjet recording device which can prevent, by an easy configuration, misalignment in a rotational direction and deterioration of image quality caused by the misalignment.

Means for Solving the Problem

In order to achieve the above object, the invention according to claim 1 is an inkjet recording device including a plurality of head modules in each of which a plurality of recording heads is one-dimensionally arranged and fixed, each of the recording heads having a plurality of nozzle openings which is provided in a predetermined pattern arrangement on a nozzle surface, wherein each of the plurality of head modules is attached, at both ends in a width direction, to an attachment member so that the plurality of recording heads is arranged in the width direction, the width direction being perpendicular to a conveyance direction of a recording medium, and an image is formed on the recording medium by ejecting ink from the nozzle openings.

The invention according to claim 2 is the inkjet recording device according to claim 1, wherein the plurality of head modules is arranged in parallel at two or more positions which are different in the conveyance direction so that the recording heads are arranged in a staggered manner.

The invention according to claim 3 is the inkjet recording device according to claim 2, further including a conveyance section which conveys the recording medium on a conveyance surface having a curvature in the conveyance direction while making the recording medium face the nozzle surface, wherein each of the plurality of head modules is arranged so that the nozzle surface is perpendicular to a perpendicular line from a center in the conveyance direction of the nozzle surface to the conveyance surface.

The invention according to claim 4 is the inkjet recording device according to claim 2 or 3, wherein the plurality of head modules arranged in parallel in the conveyance direction has concave and convex shapes in the width direction in respective lateral surfaces which are adjacent to each other, and the concave and convex shapes are arranged so that a convex part in one lateral surface faces a concave part in the other lateral surface.

The invention according to claim 5 is the inkjet recording device according to claim 2 or 3, wherein the plurality of head modules arranged in parallel in the conveyance direction is in a relative arrangement so that a portion over a predetermined length from each of lateral surfaces which are adjacent to each other is formed to be thinner than the other portion.

The invention according to claim 6 is the inkjet recording device according to any one of claims 1 to 5, wherein the plurality of nozzle openings provided on the nozzle surface is two-dimensionally arranged in each of the recording heads, a formation region of the plurality of nozzle openings which are two-dimensionally arranged is equally divided into a first predetermined number of nozzle blocks in the conveyance direction, the first predetermined number being two or more, the plurality of nozzle openings in each of the nozzle blocks is provided so that each of the nozzle openings and an adjacent nozzle opening at positions adjacent to each other in the width direction are arranged at a predetermined first interval in the width direction, and the nozzle openings provided in the first predetermined number of respective nozzle blocks are arranged so as to be shifted from each other by a second interval in the width direction, the second interval being obtained by dividing the first interval by the first predetermined number.

The invention according to claim 7 is the inkjet recording device according to claim 6, wherein the first predetermined number is four or more, and the first predetermined number of nozzle blocks are arranged so that an adjacent nozzle block is separated from one nozzle block in the conveyance direction by a second predetermined number of nozzle blocks or less, the second predetermined number being smaller than the first predetermined number by two or more, and the adjacent nozzle block being a block of the nozzle openings which are arranged so as to be shifted from the nozzle openings belonging to the one nozzle block by the second interval in the width direction.

The invention according to claim 8 is the inkjet recording device according to claim 6 or 7, wherein the first predetermined number is four, and the first interval is a width such that 300 nozzle openings per inch are arranged.

The invention according to claim 9 is the inkjet recording device according to any one of claims 6 to 8, wherein the plurality of nozzle openings belonging to each of the nozzle blocks is provided in a pattern in which a row number of nozzle rows are arranged in the conveyance direction and the nozzle openings in the respective nozzle rows are arranged so as to be shifted from each other by the first interval, each of the nozzle rows being formed by the nozzle openings which are arranged at a predetermined third interval in the width direction, and the row number being obtained by dividing the third interval by the first interval.

Effects of the Invention

According to the present invention, there is an effect that the misalignment in a rotational direction and image deterioration caused by the misalignment can be prevented by an easy configuration in an inkjet recording device.

EMBODIMENTS FOR CARRYING OUT THE INVENTION

Hereinafter, an embodiment of the present invention will be described with reference to the drawings.

Figure 1:
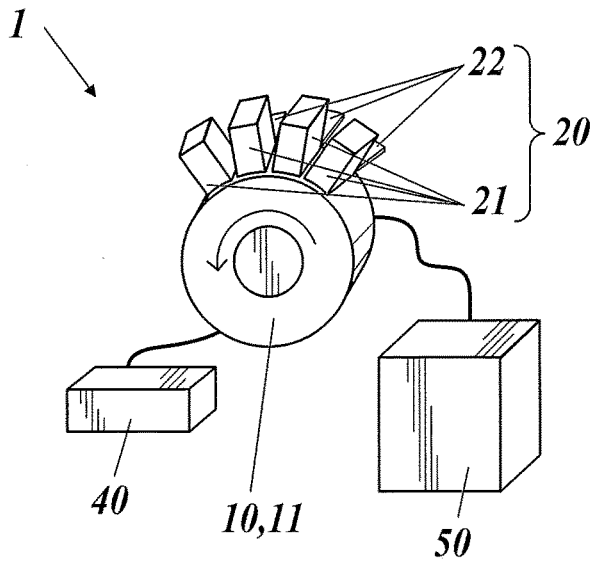
FIG. 1 This is a schematic view showing an entire configuration of an inkjet recording device.

FIG. 1 is a schematic view showing an entire configuration of an inkjet recording device 1 in the embodiment of the present invention.

The inkjet recording device 1 includes a conveyance section 10, an image forming section 20, a control section 40, an ink supply section 50 and such like. In the inkjet recording device 1, on the basis of control by the control section 40, image formation is performed to a recording medium P in the image forming section 20 by ink supplied from the ink supply section 50, the recording medium P being conveyed by the conveyance section 10 to a position facing the image forming section 20, and thereafter, the recording medium P is ejected.

The conveyance section 10 holds the recording medium P on which an image is to be formed, conveys the recording medium P so as to face the image forming section 20, and further ejects the recording medium P on which an image is formed. The conveyance section 10 includes an image forming drum 11.

The image forming drum 11 holds the recording medium P along the outer circumferential surface of a cylindrical shape, and conveys the recording medium P according to the rotation thereof. The outer circumferential surface (conveyance surface) of the image forming drum 11 faces the head units 21 and performs processing according to image formation to the conveyed recording medium P.

The image forming section 20 forms an image by ejecting ink onto the recording medium P. The image forming section 20 has the head units 21, the cleaning sections 22 and such like.

The head units 21 eject the ink to the recording medium P held by the image forming drum 11, and form an image. The head units 21 are provided for respective colors of C (cyan), M (magenta), Y (yellow) and K (black). In FIG. 1, the head units 21 are provided in order so as to correspond to the colors of Y, M, C and K from upstream in the conveyance direction of recording medium P which is conveyed according to the rotation of the image forming drum 11.

Each of the head units 21 is provided to have a length (width) covering the entire recording medium P in the direction (width direction) perpendicular to the conveyance direction of the recording medium P. That is, the inkjet recording device 1 is a line head type inkjet recording device in a one-pass system.

The head unit 21 is formed by attaching and fixing, to an attachment member 28 (carriage, see FIG. 3), a plurality of nozzle units which are formed by bonding a common ink chamber to recording heads 2811 (head chips, see FIG. 3), and the head unit 21 is arranged so as to face the recording medium P when image formation is performed. The surfaces (bottom surfaces) of the recording heads 2811 facing the recording medium P are nozzle surfaces in each of which a plurality of nozzle openings for ejecting ink is arranged in a predetermined pattern.

Figure 2:
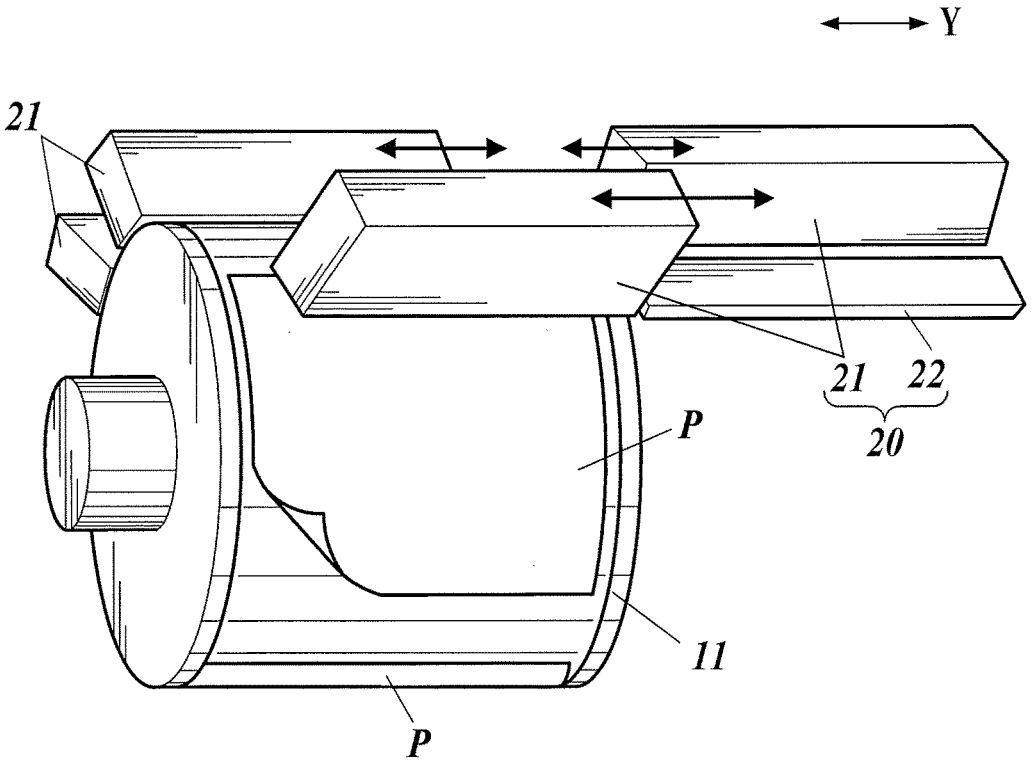
FIG. 2 This is a perspective view showing a positional relationship between an image forming drum and a cleaning section and positions of a head unit before and after movement.

FIG. 2 is a perspective view showing the positional relationship between the image forming drum 10 and the cleaning section 22 and the positions of head unit 21 before and after movement.

Each of the head units 21 is provided so as to be movable, in accordance with the movement operation of the attachment member 28, in the direction (Y direction) perpendicular to the conveyance direction of recording medium P, that is, the movement direction of outer circumferential surface according to the rotation of image forming drum 11. The cleaning section 22 for removing the dirt of nozzle surfaces is arranged in parallel with the image forming drum 11 in the Y direction. The head unit 21 can perform a reciprocating movement between the position facing the image forming drum 11 and the position facing the cleaning section 22 on the basis of control by the control section 40.

The control section 40 controls the operations of sections in the inkjet recording device 1 and integrally controls the entire operation. The control section 40 includes a CPU (Central Processing Unit), a ROM (Read Only Memory), a RAM (Random Access Memory) and such like. The control section 40 executes the program, which was read out from the ROM, in the RAM by the CPU, and executes various control processing.

The ink supply section 50 includes an ink tank and a pump, and supplies ink to be ejected from the nozzle openings to the head unit 21.

Next, the nozzle arrangement in the head unit 21 will be described.

Figure 3:
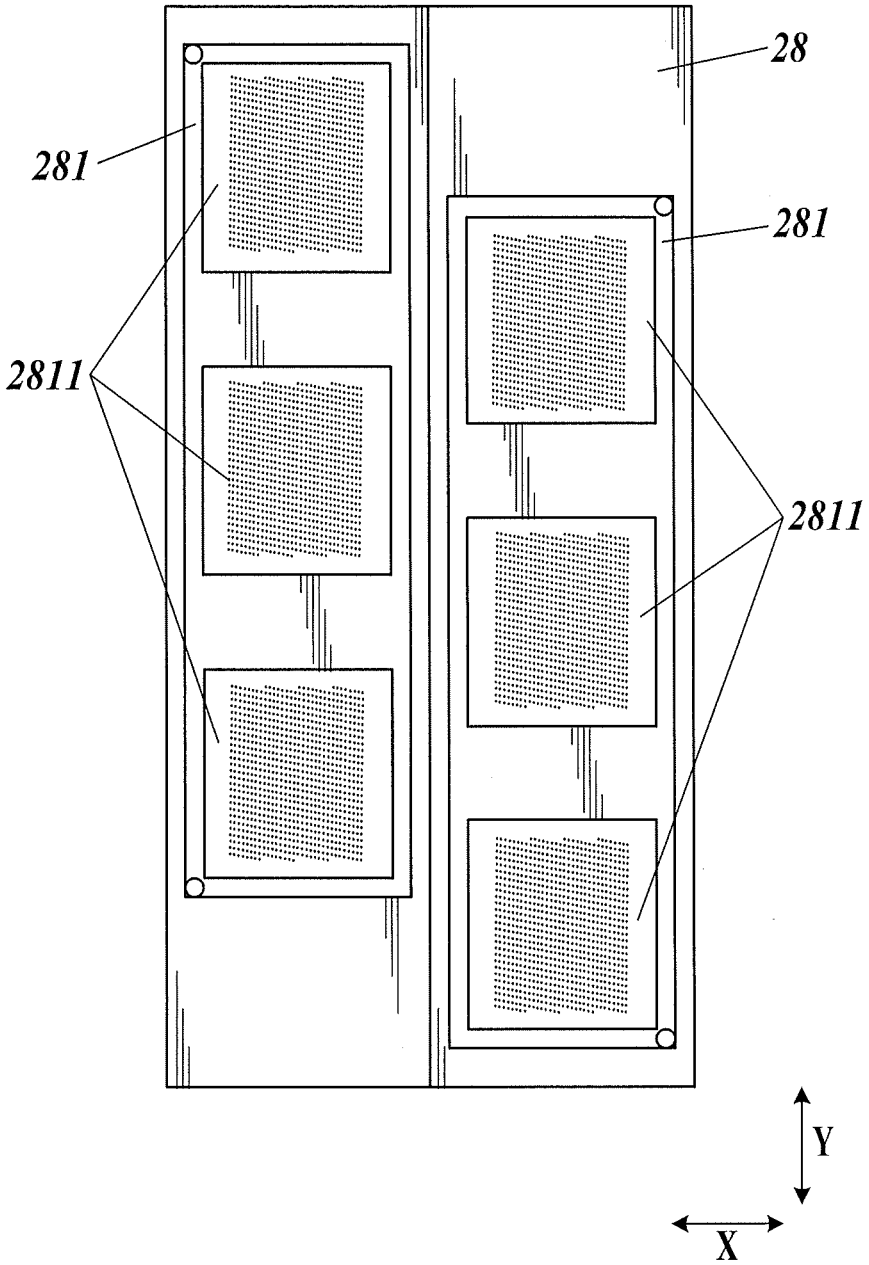
FIG. 3 This is a bottom view showing surfaces of nozzle units, the surfaces facing a recoding medium.

FIG. 3 is a bottom view showing nozzle surfaces in the head unit 21 facing the recording medium P.

The head unit 21 is provided with head modules 281 in each of which three recording heads 2811 (nozzle units) are arranged in a one-dimensional direction (in a straight line) and integrally formed. The head module 281 is attached and fixed to the attachment member 28 so as to be extended in the width direction, two rows of the head modules 281 are provided in parallel in the conveyance direction, and as a whole, the recording heads 2811 are arranged in a staggered manner. The head modules 281 are attached to the attachment member 28 by using a screw, a bolt, a spring and such like, thus easily causing slight misalignment. In each of the head modules 281 fixed to the attachment member 28, the common ink chamber, wirings, a drive section (for example, FPC) and such like provided on the surface opposite to the nozzle surfaces are penetrating the attachment member 28 to protrude, and integrally contained inside a housing.

In this case, each of the recording heads 2811 is formed for example, by layering a flow channel substrate including ink flow channels, a piezoelectric element or vibration plate as an operation mechanism for moving and ejecting the ink in the flow channel and a circuit board or an interposer for driving the piezoelectric element, and using a MEMS (Micro Electro Mechanical Systems) technique. The head module 281 is obtained by integrally forming and fixing the plurality of recording heads 2811 by using silicon resin and such like. When forming the head module 281, an optical measuring scope or the like is used, positioning of the recording heads 2811 is performed accurately while performing image processing, and bonding is performed. Alternatively, the plurality of recording heads 2811 and the head module 281 may be initially formed integrally. Thus, the relative misalignment of each of the nozzles in the head module 281 is suppressed to be sufficiently small with respect to the nozzle resolution.

For the attachment member 28, there is used a material which hardly generates distortion or deformation due to the weight of head module 281 and heat generated at operations, for example, a metal member such as aluminum alloy. The head module 281 may be any module as long as the recording heads 2811 are fixed at appropriate positions, and the common ink chamber bonded to the recording heads 2811 may protrude from the surface (upper surface) opposite to the nozzle surface in the head module 281. In this case, the housing containing the common ink chamber, wirings and drive section connected to the interposer is bonded to the head module 281.

In the inkjet recording device 1 in the embodiment, the nozzle surface of each of the recording heads 2811 is in a nearly square shape, for example, a 30 mm square shape, and provided with 32 lines×32 rows (nozzle rows) of nozzle openings.

Figure 4:
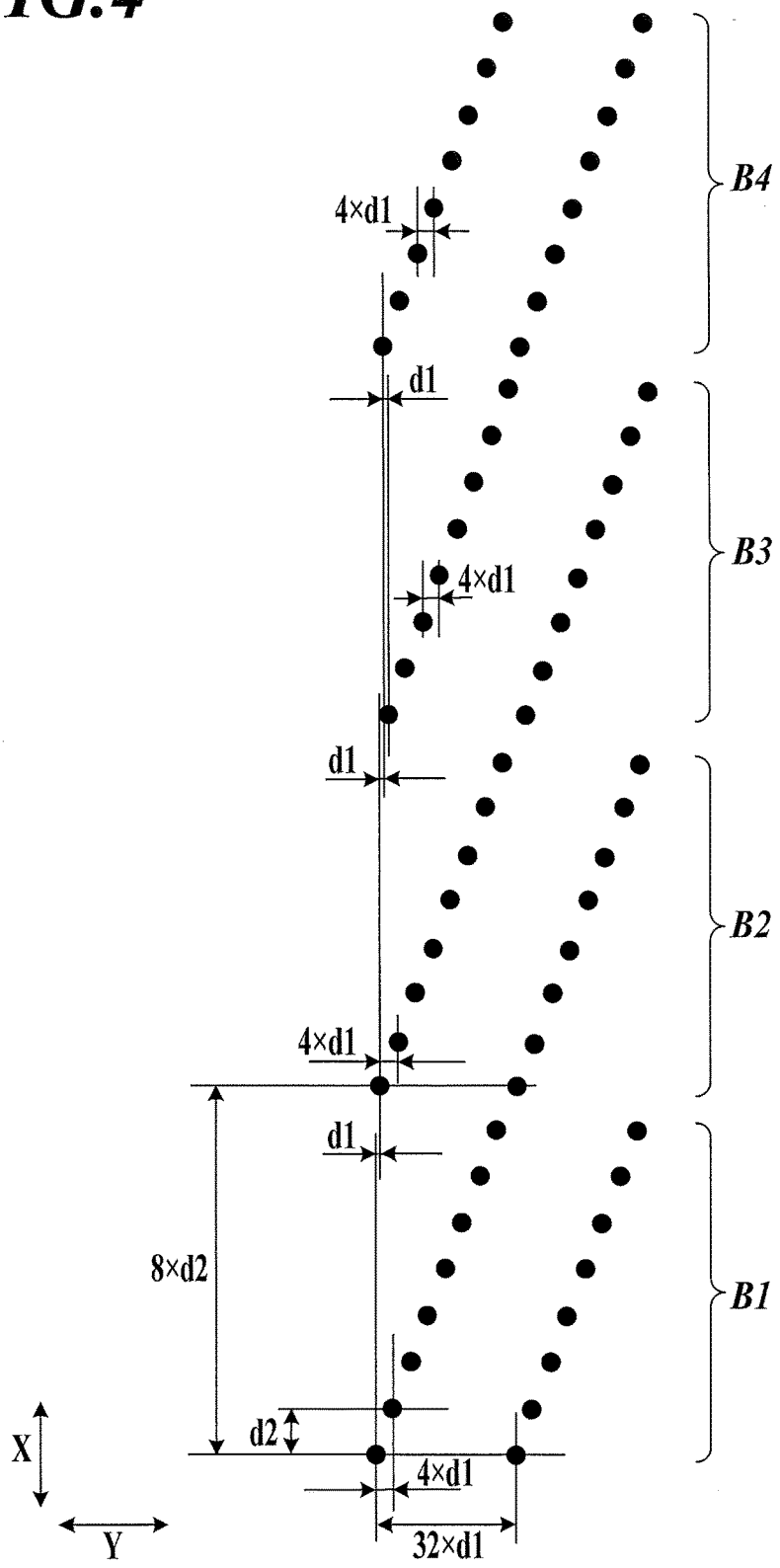
FIG. 4 This is a view for explaining nozzle arrangement on the nozzle surface.

FIG. 4 is a view for explaining nozzle arrangement in a nozzle surface.

In the nozzle surface, a plurality of nozzle openings is two-dimensionally arranged by 32 lines (only partially displayed in FIG. 4) in the width direction (Y direction) and 32 rows in the conveyance direction (X direction). In the width direction, the nozzle openings are provided at an interval (third interval) between nozzle openings of adjacent lines, the interval (third interval) being 32 times an interval d1. On the other hand, in the conveyance direction, the nozzle openings of respective lines are divided into four (first predetermined number) blocks B1 to B4 (nozzle blocks) by eight nozzle openings, and adjacent nozzle openings are provided at an interval d2 in each of the blocks. The nozzle openings in each of the blocks are arranged to be shifted from each other by a length (first interval) in the width direction, the length (first interval) being four times the interval d1. The nozzle openings in the respective four blocks are arranged to be shifted from each other by the interval d1 (second interval) in the width direction. The nozzle openings in the block B1 and the nozzle openings in the block B2 are arranged so as to be shifted from each other by the interval d1 in the width direction, the nozzle openings in the block B2 and the nozzle openings in the block B4 are arranged so as to be shifted from each other by the interval d1 in the width direction, and further, the nozzle openings in the block B4 and the nozzle openings in the block B3 are arranged so as to be shifted from each other by the interval d1 in the width direction. The recording medium P is conveyed in the conveyance direction toward the nozzle surface, the nozzles are used sequentially, and thereby, 32×32=1024 nozzle openings as a whole are arranged at the intervals d1 in the width direction.

In such way, in the order of blocks B1→B2→B4→B3, the nozzle openings adjacent in the width direction (adjacent nozzle openings) are formed at the interval d1, and thus, the distance in the conveyance direction between the adjacent nozzle openings (movement block (adjacent nozzle block)) is within two blocks (second predetermined number) for one movement, and the change is not large. The block order satisfying such condition is not limited to the above-mentioned order.

Figure 5:
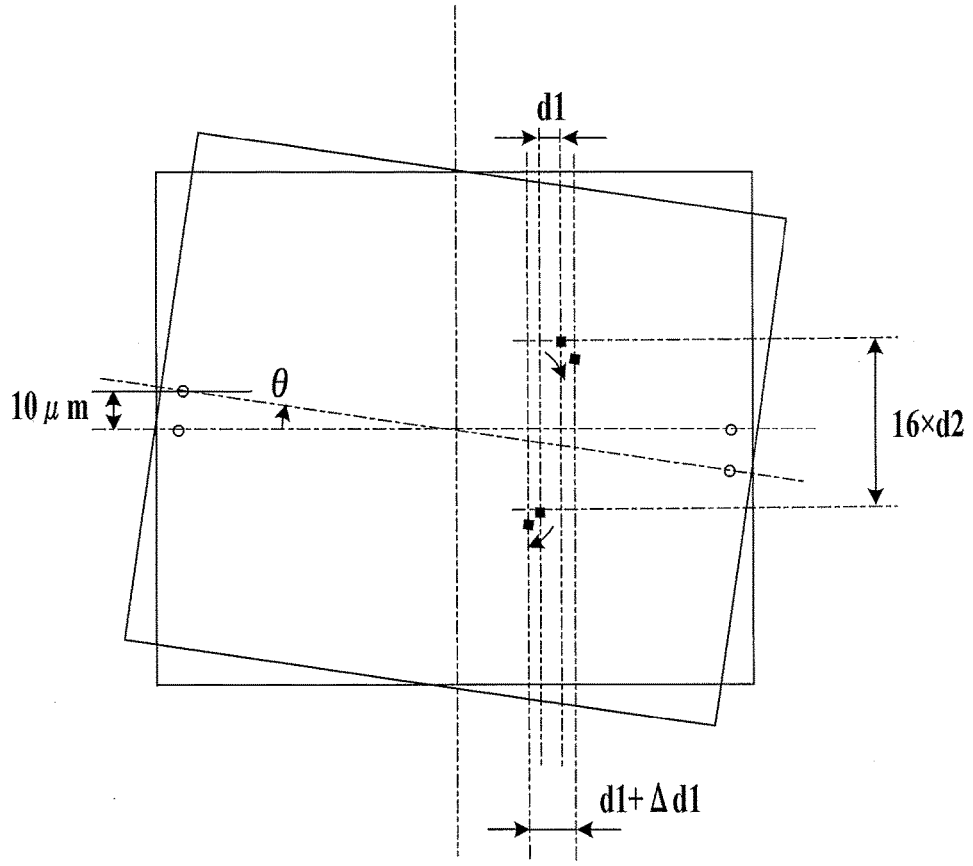
FIG. 5 This is a view for explaining rotational misalignment according to the attachment of a head module.

FIG. 5 is a view for explaining rotational misalignment according to the attachment of head module 281.

In a case where the head module 281 is attached to the attachment member 28 with a rotational shift of a minute rotation angle θ, the positions of nozzle openings also have rotational shifts. At this time, the shift directions of respective nozzle openings vary depending on positional relationships between the rotation axis and the nozzle openings. That is, the shift is larger as the nozzle opening is located farther away from the rotation axis. The nozzle openings located in the width direction with respect to the rotation axis are shifted in the conveyance direction, and the nozzle openings located in the conveyance direction with respect to the rotation axis are shifted in the width direction. Accordingly, when there are such rotational shifts, the positional relationships of ink landing positions from the nozzle openings to the recording medium P are changed.

Specifically, in a case where the 30 mm square recording head 2811 is provided with 1024 nozzle openings at 1200 dpi (interval d1 is approximately 21 μm) in the width direction and 32 nozzle openings at the interval d2=32×d1 (approximately 677 μm) in the conveyance direction, the nozzle openings are provided in the range of approximately 21.6 mm square. In a case where a single recording head 2811 is fixed to the attachment member 28, when alignment marks for positioning are provided to both ends in the width direction of recording head 2811 (for example, positions of approximately 14 mm from the rotation axis in the width direction) and shifted by ±10 μm in the conveyance direction, the nozzle opening which is farthest in the width direction from the rotation axis is shifted by approximately 8 μm in the conveyance direction, and the nozzle opening which is farthest in the conveyance direction from the rotation axis is shifted by approximately 8 μm in the width direction. The rotation angle θ in this case is approximately 0.04 degree.

Since the nozzle openings which are adjacent in the width direction are shifted by up to two blocks, 16×d2 in the conveyance direction as described above, the shift of distance in the width direction Δd1 is generated up to approximately 8 μm in accordance with the rotational shift. That is, by the rotational shift of minute rotation angle θ, the distance in the width direction between adjacent nozzle openings is shifted ⅓ of the original interval or more. Especially, the shift in the width direction is difficult to perform correction by a correction technique of ejection timing and ejection speed of ink and such like. Thus, the shift of interval between nozzle openings easily causes image deterioration, and color unevenness and streaks are generated, for example.

In the inkjet recording device 1 in the embodiment of the present invention, a plurality of (here, three) recording heads 2811 in the width direction is integrally provided to the head module 281. Accordingly, the length in the width direction of the head module 281 is three times the recording head 2811 or more. When the head module 281 is attached to the attachment member 28, even if a misalignment of the same degree (±10 μm) in the conveyance direction occurs for the attachment tool (such as screws) and alignment marks at the both ends in the width direction, the rotation angle θ of rotational shift according to the misalignment is less than ⅓, that is, the shift amount according to the interval in the width direction of nozzle openings is reduced.

At this time, when a plurality of recording heads 2811 is arranged in the conveyance direction, the distances in conveyance direction from the rotation axis to the nozzle openings are increased, thus increasing the shift amounts in the width direction with respect to the minute rotation angle θ of the nozzle openings located in the conveyance direction with respect to the rotation axis. Accordingly, in a case where a plurality of recording heads 2811 is provided in the conveyance direction, it is preferable that such plurality of recording heads 2811 is provided to different head modules 281 and 281.

Figure 6A:
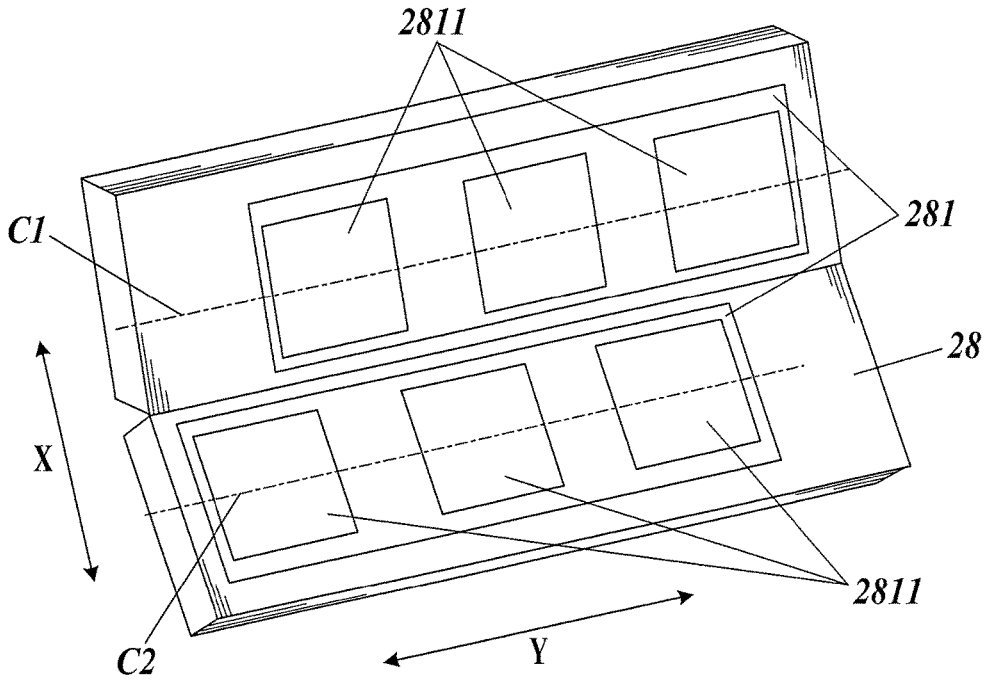
FIG. 6A This is a perspective view for explaining attachment arrangement of a plurality of head modules to an attachment member.
Figure 6B:
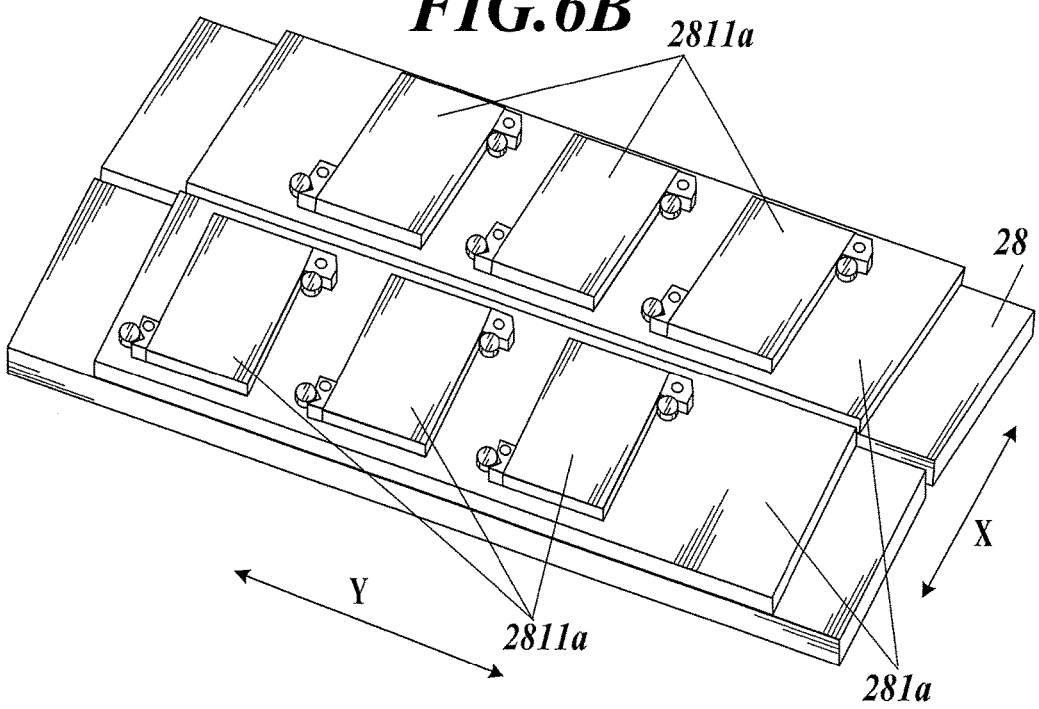
FIG. 6B This is a perspective view for explaining attachment arrangement of a plurality of head modules to an attachment member.

FIGS. 6A and 6B are perspective views for explaining the attachment arrangement of a plurality of head modules 281 to the attachment member 28.

FIG. 6A is a view of arrangement when the head modules 281 are attached to the attachment member 28 in the inkjet recording device 1 in the embodiment, the arrangement being seen from the ink ejection surfaces of the head modules 281.

Here, two head modules 281 extending in the Y direction (width direction) are arranged in parallel in the X direction (conveyance direction), and attached to the attachment member 28. At this time, the nozzle surfaces of the two head modules 281 are not in a same plane, and provided so as to be inclined to each other.

Figure 7:
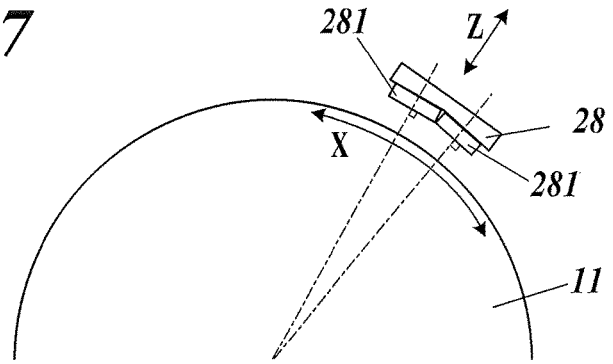
FIG. 7 This is a view for explaining a relative angle between nozzle surfaces of two head modules.

FIG. 7 is a view for explaining a relative angle of nozzle surfaces of the two head modules 281.

FIG. 7 shows a lateral view of the image forming drum 11 seen from the extending direction of the rotation axis thereof.

Each of the two head modules 281 is attached to the attachment member 28 so that the nozzle surface is perpendicular to a perpendicular plane which is perpendicular to the outer circumferential surface (conveyance surface) of the image forming drum 11 from the center line (lines C1, C2 in FIG. 6A) in the conveyance direction of the nozzle surface. In the inkjet recording device 1 using the image forming drum 11, the recording medium P on the outer circumferential surface is arranged to be curved in an arc-like shape. Thus, in a case where ink is ejected simultaneously from a plurality of nozzle openings located at different positions in the conveyance direction, there is generated a problem that the distance from nozzle opening to the recording medium P varies depending on the position in conveyance direction. Thus, the inkjet recording device 1 suppresses the difference in distance from the nozzle opening to the recording medium P to be small by individually determining the set angles of nozzle surfaces of different head modules 281 with respect to the outer circumferential surface.

The attachment member 28 may be provided separately for head modules 281 which are different in the conveyance direction, or the head modules 281 may be attached to a single attachment member 28 at different angles.

Figure 8A:
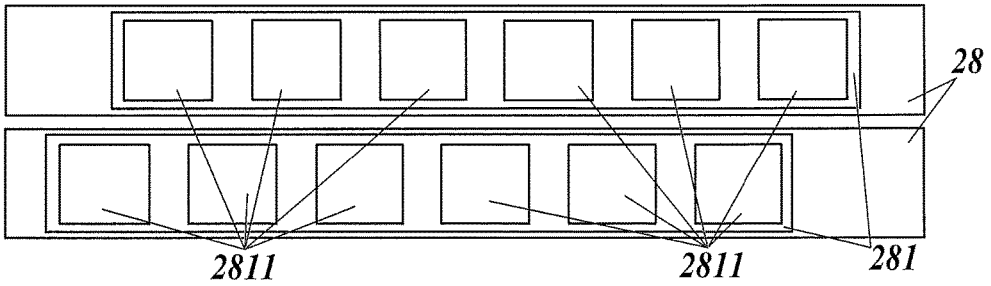
FIG. 8A This is a view for explaining attachment to attachment member when a plurality of head modules is arranged in the width direction.
Figure 8B:
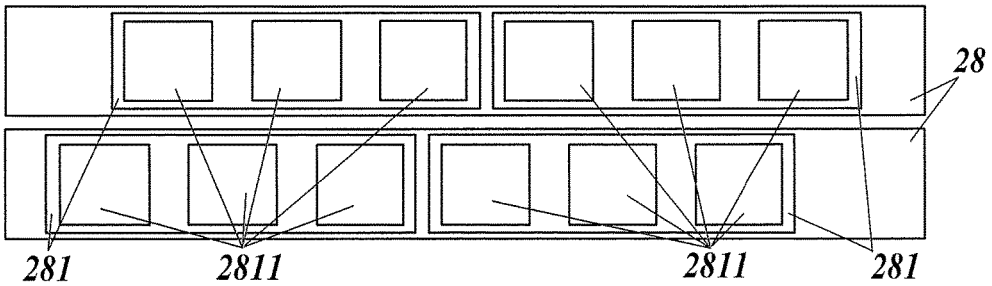
FIG. 8B This is a view for explaining attachment to attachment member when a plurality of head modules is arranged in the width direction.
Figure 8C:
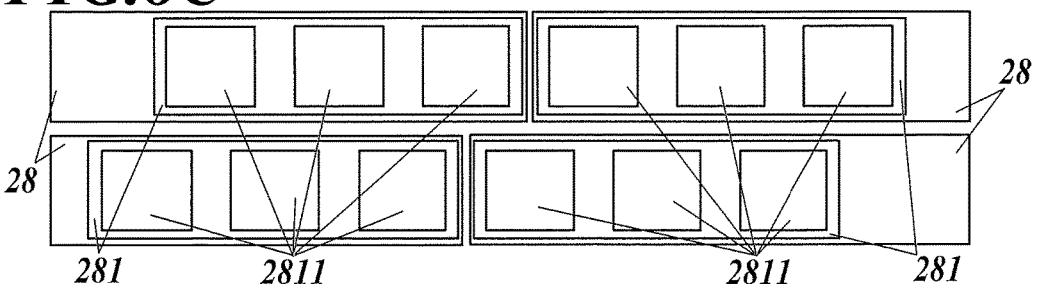
FIG. 8C This is a view for explaining attachment to attachment members when a plurality of head modules is arranged in the width direction.

FIGS. 8A to 8C are views for explaining attachment to the attachment member when a plurality of head modules 281 is arranged in the width direction.

In a line head type inkjet recording device as in the inkjet recording device 1 in the embodiment, more recording heads 2811 normally need to be arranged in the width direction. In this case, for example, as shown in FIG. 8A, there can be used a configuration in which all the recording heads 2811 arranged in the width direction are fixed to a same head module 281, and the head module 281 is attached to the attachment member 28. By extending the length in width direction of head module 281 in such way, it is possible to further suppress the influence of rotational shift due to the misalignment in conveyance direction when the head module is attached to the attachment member 28. On the other hand, when a head module 281 made of resin is lengthened, the intensity is lowered, thus causing misalignment as a result. Accordingly, in this case, it is preferable that a structure or a member which strengthens the intensity is used for the head module 281.

Next, as shown in FIG. 8B, there can be used a configuration in which a plurality of head modules 281 is arranged in the width direction to be attached to a same attachment member 28 without increasing the number of recording heads 2811 provided in a single head module 281. In this case, though the above-mentioned intensity problem is not easily generated, time is required for adjusting the shift of relative attachment positions of a plurality of head modules 281 to the attachment member 28.

Alternatively, as shown in FIG. 8C, there can be used a configuration in which a plurality of head modules 281 is arranged in the width direction and the head modules 281 are attached to separate attachment members 28. In such configuration, for example, the movement distance of attachment member 28 can be shortened by moving the attachment members 28 to the both sides of the image forming drum 11. Furthermore, since the length of attachment member 28 can be shortened, the influence such as distortion of attachment member 28 can be suppressed. On the other hand, relative positioning needs to be performed strictly when the attachment members 28 which are movable sections are arranged so as to face the recording medium P.

Modification Example 1

FIG. 6B shows a modification example 1 of head module. Head modules 281*a* in the modification example 1 are shown with a view seen from the opposite surface to the nozzle surfaces of the head modules 281*a*.

The head module 281*a* is formed by accurately positioning recording heads 2811*a* which are individually provided, and fixing the recording heads 2811*a* to the fixing member. Also at this fixation, accurate positioning is possible by using a measuring scope and image processing, and thus, the misalignment between nozzles in the head module 281*a* can be suppressed to be sufficiently small with respect to resolution.

In this case, for the fixing member of head module 281*a*, there is preferably used a metal (alloy) member which is less distorted or deformed by the weight of recording head 2811*a* and a force applied at the time of attachment.

Modification Example 2

Next, a modification example 2 of head module in the inkjet recording device 1 in the embodiment will be described.

Figure 9A:
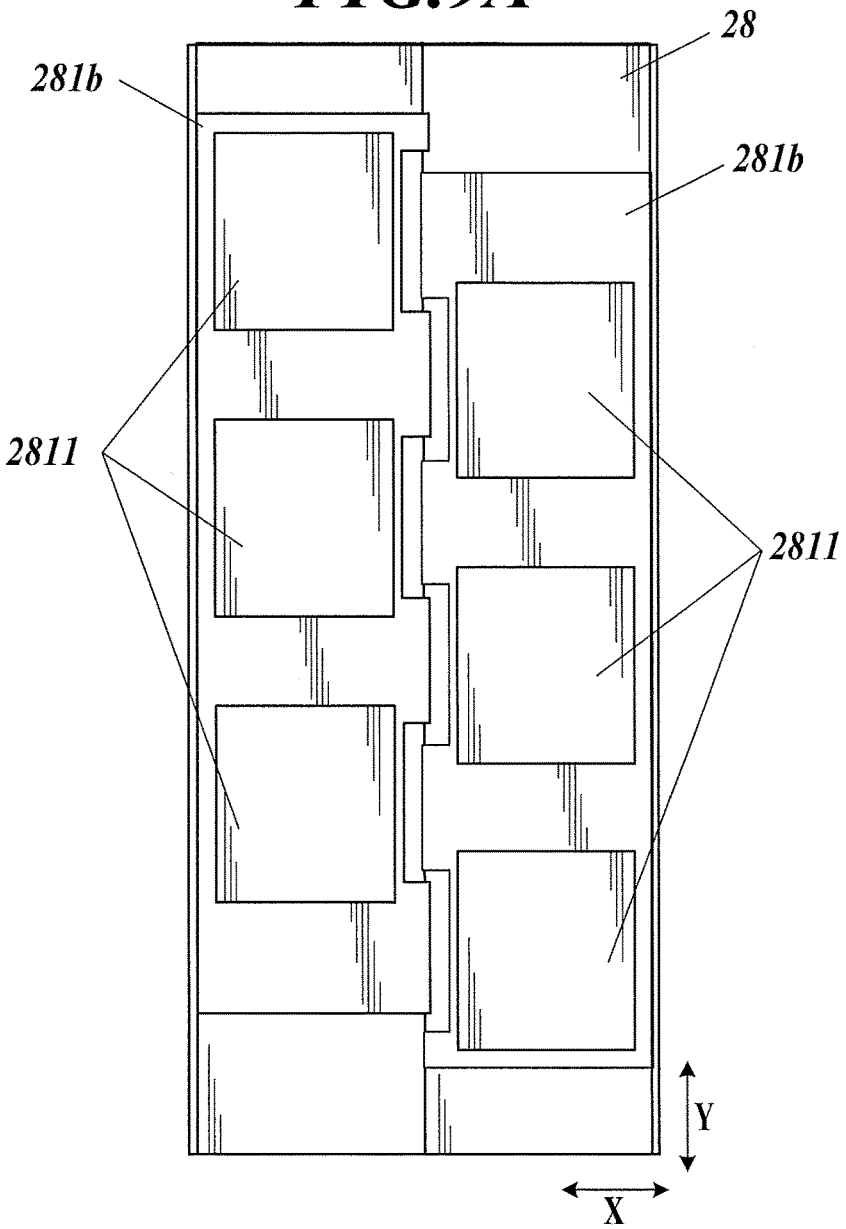
FIG. 9A This is a bottom view showing head modules in a modification example 2.
Figure 9B:
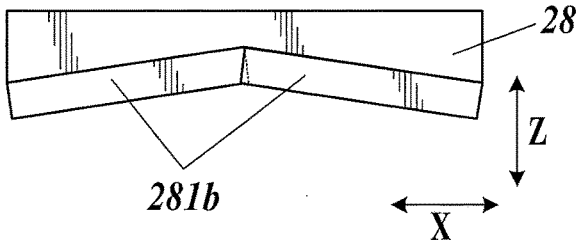
FIG. 9B This is a lateral view showing head modules in the modification example 2.

FIGS. 9A and 9B are views showing head modules 281*b* in the modification example 2.

In each of the head modules 281*b* of the modification example 2, three recording heads 2811 are integrally provided as shown in a bottom view of FIG. 9A. The head modules 281*b* are arranged so as to extend in the Y direction, and two head modules 281*b* provided in parallel in the X direction are fixed to the attachment member 28.

The head modules 281*b* in the modification example 2 are arranged so that adjacent lateral surfaces of two head modules 281*b* are formed to have concave and convex shapes extending in the width direction and the convex part of one lateral surface faces the concave part of the other lateral surface. By such shape and arrangement, as shown in the lateral view seen in the XZ plane of FIG. 9B, the nozzle surfaces do not interfere with each other when the nozzle surfaces of the head modules 281*b* have angles different from each other. Thus, it is not necessary to extend the distance between the head modules 281*b* unnecessarily.

The concave and convex shapes are not limited to the shapes shown in FIGS. 9A and 9B, and can be appropriately changed. That is, the width, number and size of the convex part are appropriately set.

Modification Examples 3 and 4

Next, modification examples 3 and 4 of head module in the inkjet recording device 1 in the embodiment will be described.

Figure 10A:
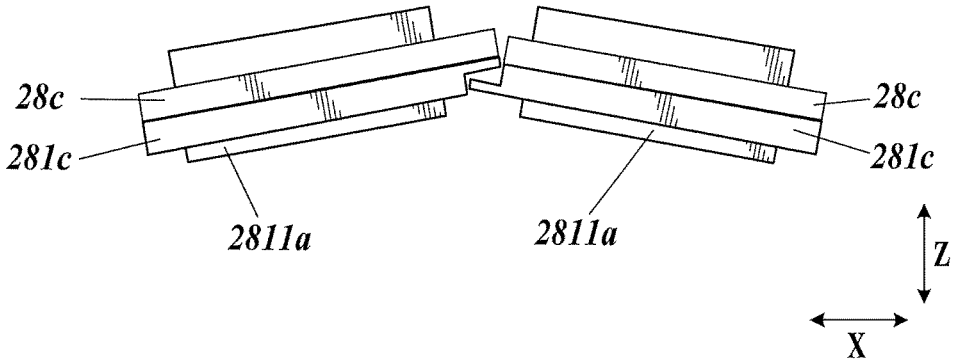
FIG. 10A This is a lateral view showing head modules in a modification example 3.
Figure 10B:
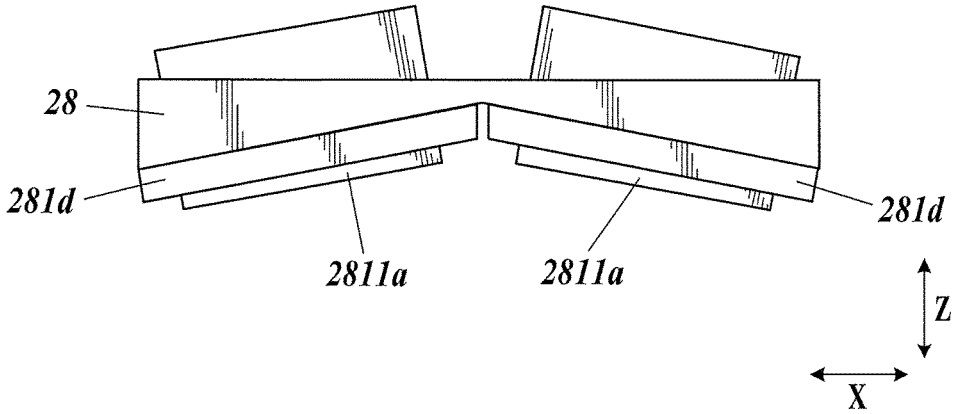
FIG. 10B This is a lateral view showing head modules in a modification example 4.

FIG. 10A is a lateral view of head modules 281*c* in the modification example 3 seen in the XZ plane. FIG. 10B is a lateral view of head modules 281*d* in the modification example 4 seen in the XZ plane.

As shown in FIG. 10A, the head modules 281*c* in the modification example 3 are formed so that the adjacent lateral surfaces of two head modules 281*c*, which are provided in parallel in the conveyance direction (X direction), have respective portions over a predetermined length at positions different in the thickness direction (nearly Z axis direction), each of the portions being formed in a plate shape thinner than the other portion. Thus, even when the two head modules 281*c* have nozzle surfaces having the angle therebetween less than 180 degrees, the nozzle surfaces do not contact each other. Here, the attachment member 28*c* corresponding to the head module 281*c* in the modification example 3 is formed separately for each of the two head modules 281*c*, thereby preventing the contact between head module 281*c* and attachment member 28*c*.

As shown in FIG. 10B, in the head modules 281*d* in the modification example 4, each of the facing lateral surfaces of two head modules 281*d* provided in parallel in the conveyance direction (X direction) is formed to have an inclination so as to form an obtuse angle with the nozzle surface. That is, the head module 281*d* is formed so that the portion on the lateral surface side is thinner than the other portion over a predetermined length and the area of nozzle surface side is smaller than the area of the opposite side. As a result, even when the angle between the nozzle surfaces of two head modules 281*d* is less than 180 degrees, the head modules do not interfere with each other. The lateral surfaces can be fixed so as to contact each other by appropriately adjusting the size of obtuse angle between the nozzle surface and the above-mentioned lateral surface and the size of angle between the nozzle surfaces.

As described above, the inkjet recording device 1 in the embodiment includes a plurality of head modules 281 in each of which three recording heads 2811 are one-dimensionally arranged and fixed, each of the recording heads 2811 having a plurality of nozzle openings which are provided in a predetermined pattern arrangement on a nozzle surface. Each of the plurality of head modules 281 is attached to the attachment member 28 at the both ends in the width direction (Y direction) so that the recording heads 2811 are arranged in the width direction (Y direction) perpendicular to the conveyance direction (X direction) of recording medium P. An image is formed on the recording medium by ejecting ink from a nozzle opening.

In such way, since the head module 281 is formed so as to be long in the width direction in a unit of recording head and to be shortest possible in the conveyance direction, even when misalignment is caused in the rotational direction at the time of attaching the head module 281 to the attachment member 28, the rotation angle by the misalignment can be suppressed to be smaller than that of conventional techniques. Accordingly, arrangement disturbance of nozzle openings due to rotational shift can be prevented more easily, and, as a result, image deterioration can be suppressed.

A plurality of head modules 281 is arranged in parallel at two different positions in the conveyance direction (X direction) so that the recording heads 2811 are arranged in a staggered manner. Thus, highly accurate images can be formed by reducing the influence of rotational misalignment according to the attachment of head module 281 while maintaining the high density arrangement of nozzle openings and high speed image formation.

In a case of using a cylindrical image forming drum 11 for conveyance of recording medium P, each of the plurality of head modules 281 arranged in parallel in the conveyance direction is arranged so as to be as parallel to the recording medium P as possible. Conventionally, the recording medium P on the image forming drum 11 is curved when ink is ejected from a plurality of nozzle openings which are two-dimensionally arranged. Thus, there has been a problem that the distances from the nozzle openings to the recording medium P are largely different. However, by including the recording heads 2811 at different positions in the conveyance direction in separate head modules 281 and attaching the head modules 281 to the attachment member 28 as in the present invention, the recording heads 2811 can be arranged at appropriate positions and angles easily, and the difference in the distances from nozzle openings to the recording medium P can be suppressed to be small, and thus, image deterioration can be suppressed.

As for a plurality of head modules 281 which are arranged in parallel in the conveyance direction, adjacent lateral surfaces have concave and convex shapes in the width direction, and the convex part in one lateral surface is arranged so as to face the concave part in the other lateral surface. Thus, since the nozzle surfaces do not interfere with each other when the nozzle surfaces are arranged to be inclined to each other, the head modules 281 can be arranged at a shorter distance in the conveyance direction than the distance in a case of a simple rectangular parallelepiped.

As for a plurality of head modules 281 which are arranged in parallel in the conveyance direction, the nozzle surfaces do not interfere with each other when the nozzle surfaces are inclined to each other, also by forming each of the adjacent lateral surfaces to have a portion thinner than the other portion over a predetermined length and arranging the adjacent lateral surfaces in a relative arrangement. Thus, the head modules 281 can be arranged at a shorter distance in the conveyance direction than the distance in a case of a simple rectangular parallelepiped.

The plurality of nozzle openings is two-dimensionally arranged in each of the recording heads 2811, and equally divided into the four blocks of B1 to B4 in the conveyance direction. The plurality of nozzle openings provided in each of the blocks B1 to B4 is arranged so that each of the nozzle openings and an adjacent nozzle opening at positions adjacent to each other in the width direction are arranged at the interval d1×4, and the nozzle openings provided in the respective four blocks B1 to B4 are arranged to be shifted from each other in the width direction by the interval obtained by dividing the interval d1×4 by the block number of 4, that is, the interval d1.

Thus, it is possible to perform image formation with high accuracy by arranging the nozzle openings at such a density that image formation will not be possible if the nozzle openings are simply arranged on one or two straight lines. By using the configuration of reducing the influence of rotational shift according to the present invention in a case of arranging the nozzle openings at high density, the deterioration of highly accurate images can be prevented more effectively.

Especially when the block division number is 4 or more, the divided blocks are arranged in order so that a block is separated from one block by the (block division number—2) blocks or less in the conveyance direction, the block being a block of nozzle openings which are shifted from the nozzle openings belonging to the one block by the interval d1 in the width direction. Thus, the relative distance in the conveyance direction of nozzle openings adjacent in the width direction can be suppressed to be small, and thus, it is possible to effectively prevent the increase of relative misalignment in the width direction caused by the rotational shift.

Especially, by setting the block division number to 4 and forming each of the blocks in a shape of arranging 300 nozzle openings per inch as formed in conventional inkjet recording devices, it is possible to make a highly accurate recording head 2811 in which 1200 nozzle openings per inch are arranged effortlessly and easily. Accordingly, highly accurate images can be formed easily.

The plurality of nozzle openings belonging to each of the blocks is provided in a pattern in which 8 nozzle rows are provided so as to be shifted from each other by the interval d1×4, each of the nozzle rows being formed by nozzle openings which are arranged at the interval d1×32 in the width direction. Thus, it is possible to form the recording heads 2811 which can perform image formation with high resolution more easily by repeating the same pattern.

The present invention is not limited to the embodiment and various changes can be made.

For example, the embodiment has been described that the inkjet recording device 1 is a line head. However, the inkjet recording device 1 may be a scan type not being formed over the entire image formation width as long as there is provided a plurality of head modules in each of which a plurality of recording heads is arranged in the width direction.

The embodiment has been described that the head module 281 is fixed at the both ends in the width direction. However, the both ends do not need to be strictly within a predetermined distance from the both lateral surfaces as long as the both ends are in the range not disturbing the arrangement of nozzle openings and located at positions farther away from the center than the positions when a single recording head 2811 is attached directly to the attachment member 28. The both ends may be located at the positions shifted from a center in the conveyance direction. However, it is possible to suppress the influence of rotational shift more effectively as the both ends are closer to the both lateral surfaces. The positions to be fixed are not limited to two positions. For example, even when the head module 281 is fixed to the attachment member 28 at four positions, the rotational shift possibly occurs according to the relative misalignment.

The embodiment has been described by taking, as an example, a case where the recording medium P is conveyed along the outer circumferential surface of image forming drum 11. However, the recording medium P may be conveyed on a plane. In this case, the head modules 281 provided at positions which are different in the conveyance direction are arranged so as to face the conveyance surface at the same angle. The configuration of conveying the recording medium P which is curved is not limited to the outer circumferential surface of cylindrical image forming drum, and for example, may be an internal circumferential surface (concave surface) of a semi-cylindrical shape and an elliptic cylindrical shape.

The embodiment has been described for a case where nozzle openings are two-dimensionally arranged on the nozzle surface of each of the recording heads 2811. However, the effect according to the present invention can be obtained even for the nozzle openings which are one-dimensionally arranged in the width direction. In a case of two-dimensional arrangement, the number of rows and lines of nozzle openings which are provided in the conveyance direction and width direction can be set appropriately.

In the embodiment, the nozzle openings are divided into four blocks and arranged to have an appropriate positional relationship with each other. However, such division may not be performed to the recording heads 2811. The number of divided blocks is not limited to 4. In a case where the number of blocks is 4 or more, the nozzle arrangement in each of the blocks can be determined so that the movement amount in the conveyance direction of block of the nozzle openings adjacent to each other in the width direction is two blocks or less regardless of the number of blocks.

The nozzle arrangement in each of the blocks is not limited to a case of shifting in order in the conveyance direction as shown in the embodiment, and the order may be changed.

The other specific details such as configurations, structures, arrangements and shapes shown in the embodiment can be appropriately modified within the scope of the present invention.

INDUSTRIAL APPLICABILITY

The present invention is applicable in an inkjet recording device which includes a plurality of recording heads.

EXPLANATION OF REFERENCE NUMERALS

1 inkjet recording device
10 conveyance section
11 image forming drum
20 image forming section
21 head unit
22 cleaning section
28 attachment member
281 head module
281*a* head module
281*b* head module
281*c* head module
281*d* head module
2811 recording head
2811*a* recording head
28*c* attachment member
control section
ink supply section
P recording medium

The invention claimed is:

1. An inkjet recording device comprising a plurality of head modules in each of which a plurality of recording heads is one-dimensionally arranged and fixed, each of the recording heads having a plurality of nozzle openings which is provided in a predetermined pattern arrangement on a nozzle surface, wherein each of the plurality of head modules is attached, at both ends in a width direction, to an attachment member so that the plurality of recording heads is arranged in the width direction, the width direction being perpendicular to a conveyance direction of a recording medium, and an image is formed on the recording medium by ejecting ink from the nozzle openings;

wherein the plurality of nozzle openings provided on the nozzle surface is two-dimensionally arranged in each of the recording heads, a formation region of the plurality of nozzle openings which are two-dimensionally arranged is equally divided into a first predetermined number of nozzle blocks in the conveyance direction, the first predetermined number being two or more, the plurality of nozzle openings in each of the nozzle blocks is provided so that each of the nozzle openings and an adjacent nozzle opening at positions adjacent to each other in the width direction are arranged at a predeterminded first interval in the width direction, and the nozzle openings provided in the first predeterminded number of respective nozzle blocks are arranged so as to be shifted from each other by a second interval in the width direction, the second interval being obtained by dividing the first interval by the first predeterminded number;

the first predeterminded number is four or more, and the first predeterminded number of nozzle blocks are arranged so that an adjacent nozzle block is separated from one nozzle block in the conveyance direction by a second predeterminded number of nozzle blocks or less, the second predeterminded number being smaller than the first predeterminded number by two or more, and the adjacent nozzle block being a block of the nozzle openings which are arranged so as to be shifted from the nozzle openings belonging to the one nozzle block by the second interval in the width direction.

2. The inkjet recording device according to claim 1, wherein the plurality of head modules is arranged in parallel at two or more positions which are different in the conveyance direction so that the recording heads are arranged in a staggered manner.

3. The inkjet recording device according to claim 2, further comprising a conveyance section which conveys the recording medium on a conveyance surface having a curvature in the conveyance direction while making the recording medium face the nozzle surface, wherein each of the plurality of head modules is arranged so that the nozzle surface is perpendicular to a perpendicular line from a center in the conveyance direction of the nozzle surface to the conveyance surface.

4. The inkjet recording device according to claim 2, wherein the plurality of head modules arranged in parallel in the conveyance direction has concave and convex shapes in the width direction in respective lateral surfaces which are adjacent to each other, and the concave and convex shapes are arranged so that a convex part in one lateral surface faces a concave part in the other lateral surface.

5. The inkjet recording device according to claim 2, wherein the plurality of head modules arranged in parallel in the conveyance direction is in a relative arrangement so that a portion over a predetermined length from each of lateral surfaces which are adjacent to each other is formed to be thinner than the other portion.

6. The inkjet recording device according to claim 1, wherein a length in the width direction of a head module is larger than a length of a single recording head which is fixed to the head module.

7. The inkjet recording device according to claim 1, wherein the first predetermined number is four, and the first interval is a width such that 300 nozzle openings per inch are arranged.

8. The inkjet recording device according to claim 1, wherein the plurality of nozzle openings belonging to each of the nozzle blocks is provided in a pattern in which a row number of nozzle rows are arranged in the conveyance direction and the nozzle openings in the respective nozzle rows are arranged so as to be shifted from each other by the first interval, each of the nozzle rows being formed by the nozzle openings which are arranged at a predetermined third interval in the width direction, and the row number being obtained by dividing the third interval by the first interval.

9. The inkjet recording device according to claim 7, wherein the plurality of nozzle openings belonging to each of the nozzle blocks is provided in a pattern in which a row number of nozzle rows are arranged in the conveyance direction and the nozzle openings in the respective nozzle rows are arranged so as to be shifted from each other by the first interval, each of the nozzle rows being formed by the nozzle openings which are arranged at a predetermined third interval in the width direction, and the row number being obtained by dividing the third interval by the first interval.

10. An inkjet recording device comprising a plurality of head modules in each of which a plurality of recording heads is one-dimensionally arranged and fixed, each of the recording heads having a plurality of nozzle openings which is provided in a predeterminded pattern arrangement on a nozzle surface, wherein each of the plurality of head modules is attached, at both ends in a width direction, to an attachment member so that the plurality of recording heads is arranged in the width direction, the width direction being perpendicular to a conveyance direction of a recording medium, and an image is formed on the recording medium by ejecting ink from the nozzle openings; wherein the plurality of nozzle openings provided on the nozzle surface is two-dimensionally arranged in each of the recording heads, a formation region of the plurality of nozzle openings which are two-dimensionally arranged is equally divided into a first predetermined number of nozzle blocks in the conveyance direction, the first predetermined number being two or more, the plurality of nozzle openings in each of the nozzle blocks is provided so that each of the nozzle openings and an adjacent nozzle opening at positions adjacent to each other in the width direction are arranged at a predetermined first interval in the width direction, and the nozzle openings provided in the first predetermined number of respective nozzle blocks are arranged so as to be shifted from each other by a second interval in the width direction, the second interval being obtained by dividing the first interval by the first predetermined number;

wherein the first predetermined number is four, and the first interval is a width such that 300 nozzle openings per inch are arranged.

11. The inkjet recording device according to claim 10, wherein the plurality of nozzle openings belonging to each of the nozzle blocks is provided in a pattern in which a row number of nozzle rows are arranged in the conveyance direction and the nozzle openings in the respective nozzle rows are arranged so as to be shifted from each other by the first interval, each of the nozzle rows being formed by the nozzle openings which are arranged at a predetermined third interval in the width direction, and the row number being obtained by dividing the third interval by the first interval.

12. An inkjet recording device comprising a plurality of head modules in each of which a plurality of recording heads is one-dimensionally arranged and fixed, each of the recording heads having a plurality of nozzle openings which is provided in a predetermined pattern arrangement on a nozzle surface wherein each of the plurality of head modules is attached, at both ends in a width direction, to an attachment member so that the plurality of recording heads is arranged in the width direction, the width direction being perpendicular to a conveyance direction of a recording medium, and an image is formed on the recording medium by ejecting ink from the nozzle openings; wherein the plurality of nozzle openings provided on the nozzle surface is two-dimensionally arranged in each of the recording heads, a formation region of the plurality of nozzle openings which are two-dimensionally arranged is equally divided into a first predetermined number of nozzle blocks in the conveyance direction, the first predetermined number being two or more, the plurality of nozzle openings in each of the nozzle blocks is provided so that each of the nozzle openings and an adjacent nozzle opening at positions adjacent to each other in the width direction are arranged at a predetermined first interval in the width direction, and the nozzle openings provided in the first predetermined number of respective nozzle blocks are arranged so as to be shifted from each other by a second interval in the width direction, the second interval being obtained by dividing the first interval by the first predetermined number;

wherein the plurality of nozzle openings belonging to each of the nozzle blocks is provided in a pattern in which a row number of nozzle rows are arranged in the conveyance direction and the nozzle openings in the respective nozzle rows are arranged so as to be shifted from each other by the first interval, each of the nozzle rows being formed by the nozzle openings which are arranged at a predetermined third interval in the width direction, and the row number being obtained by dividing the third interval by the first interval.

* * * * *